United States Patent [19]

Binder et al.

[11] 4,006,799

[45] Feb. 8, 1977

[54] SPEED LIMITING DEVICE FOR LIFTS OR THE LIKE

[75] Inventors: Heinrich Binder; Rudolf Glawion; Ernst Gruessy, all of Lucerne; Peter Hitz, Ebikon; Kurt Oetterli, Eschenbach; Hans Seidl, Ebikon; Hans Stoeckli, Emmenbrucke, all of Switzerland

[73] Assignee: Inventio AG, Hergiswil, Switzerland

[22] Filed: June 20, 1975

[21] Appl. No.: 588,940

[30] Foreign Application Priority Data

June 24, 1974 Switzerland ..... 8610/74

[52] U.S. Cl. ..... 187/38; 188/188; 254/173 R

[51] Int. Cl.[2] ..... B66B 5/04

[58] Field of Search ..... 187/38, 39, 71, 77, 187/79; 188/188; 254/187 E, 186 R, 173 R

[56] References Cited

UNITED STATES PATENTS

| | | | |
|---|---|---|---|
| 753,135 | 2/1904 | Hanford | 187/71 |
| 1,054,923 | 3/1913 | Kenny | 188/188 |
| 1,291,195 | 1/1919 | Shepard | 187/38 |
| 1,549,736 | 8/1925 | McCormick | 187/39 |
| 1,873,809 | 8/1932 | Baldwin | 187/39 |
| 1,905,274 | 4/1933 | Dunlop | 188/188 |
| 1,932,062 | 10/1933 | Baldwin | 188/188 |
| 2,244,893 | 6/1941 | Panter | 187/38 |
| 3,327,811 | 6/1967 | Mastroberte | 188/188 |
| 3,346,073 | 10/1967 | Martin | 188/188 |
| 3,830,346 | 8/1974 | Watts | 188/188 |

*Primary Examiner*—Evon C. Blunk
*Assistant Examiner*—Jeffrey V. Nase
*Attorney, Agent, or Firm*—Werner W. Kleeman

[57] ABSTRACT

A speed limiting device for lifts or the like comprising a cable wheel drivable by means of a speed limiter cable secured to the lift cabin, a cam disk fixably connected with the cable wheel and seated upon a common shaft or axle, and a support movable by the cam disk and the speed limiting device upon exceeding a predetermined lift travel speed, decelerating the speed limiter cable. There is provided a separate cable brake acting upon the limiter cable and an actuation mechanism which can be actuated with a tilting behavior upon activating the separate cable brake. The actuation mechanism comprises at least one mass body accelerated by the support proportional to the lift travel speed during rotation of the cam disk, the mass body upon exceeding a predetermined travel speed is movable relative to the support under the action of the inertia forces for releasing or triggering the actuation mechanism.

6 Claims, 7 Drawing Figures

Fig. 4
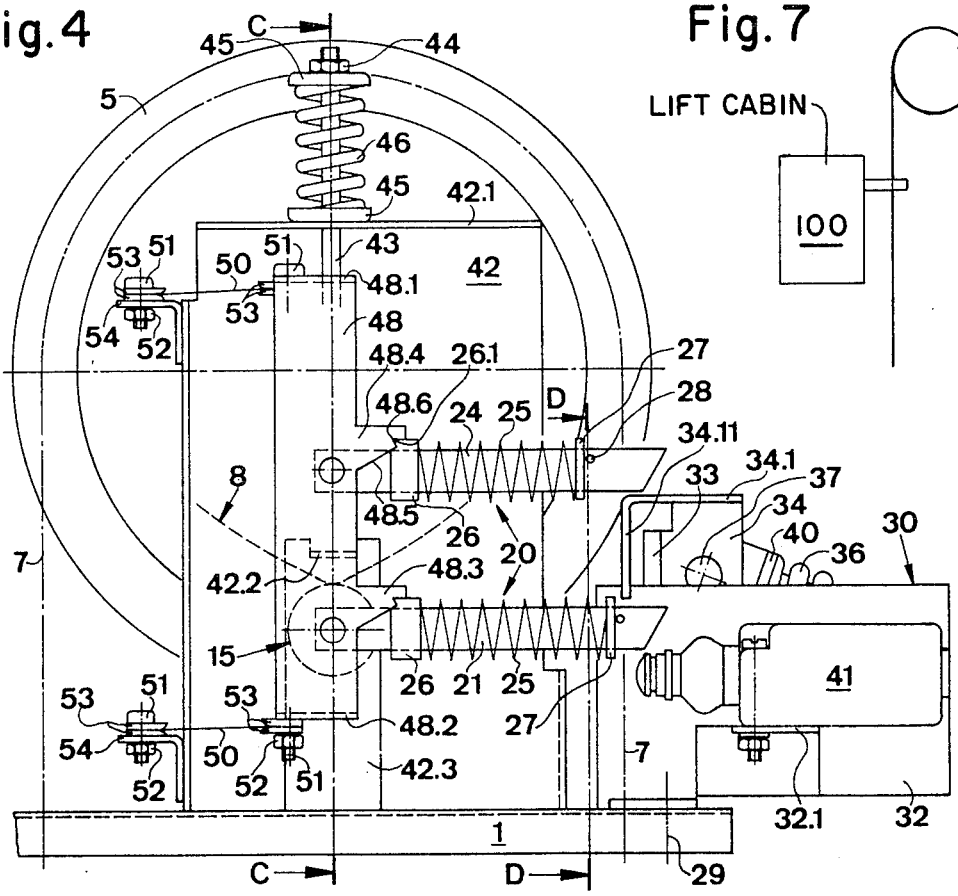
Fig. 7
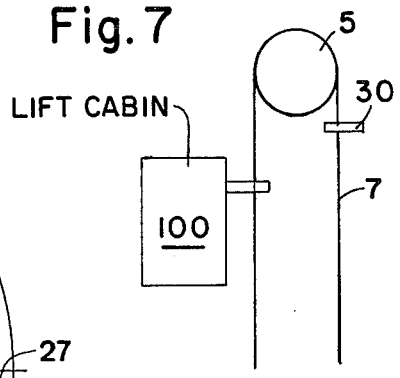
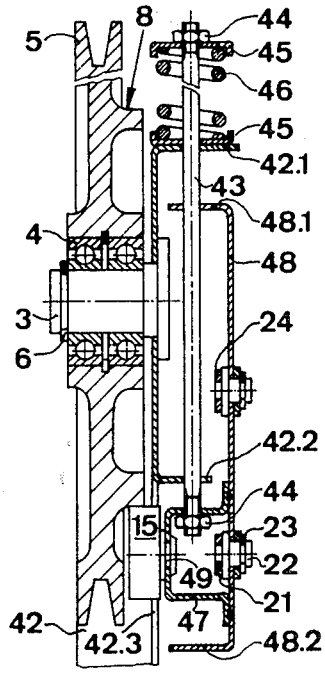
Fig. 5
Fig. 6
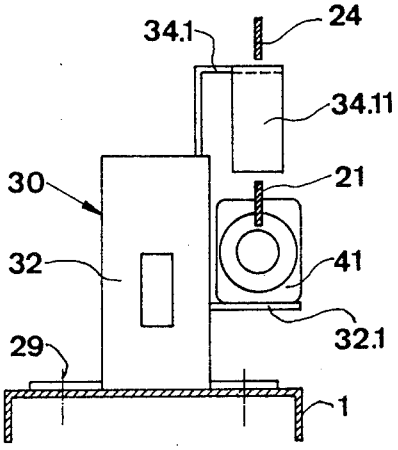

SPEED LIMITING DEVICE FOR LIFTS OR THE LIKE

BACKGROUND OF THE INVENTION

The present invention relates to a new and improved construction of speed limiting device for lifts or the like of the type comprising a cable wheel drivable by a limiter cable secured to the lift cabin, a cam disk fixedly connected with the cable wheel and seated therewith upon a common shaft or axle and a support movable by the cam disk and wherein the speed limiting device, when there is exceeded a predetermined lift travel speed, decelerating or retarding the limiter cable.

Passenger lifts and freight lifts used by individuals must be equipped with a catch mechanism which is triggered by a speed limiter, mounted at the upper end of the lift chute or shaft and driven at a rotational speed proportional to the speed of travel of the lift cabin, upon exceeding the normal travel speed by a predetermined value.

The heretofore known speed limiters or speed limiting devices are classified into two main groups, the pendulum limiters and the centrifugal limiters.

With the state-of-the-art pendulum limiters a pendulum lever which is subjected to the pressure of a spring is placed into oscillatory motion by a revolving cam of a cam disk which is fixedly connected with a cable wheel, and depending upon the shape of the cam there is imparted to the pendulum lever certain accelerations. With impermissible speed of the lift the pendulum lever swings-out a greater extent and thus causes a pawl which is fixedly connected therewith to come into engagement with the teeth of a blocking wheel which is likewise fixedly mounted at the cable wheel, so that the speed limiter is instantaneously blocked. The drive cable which is trained about the cable wheel of the speed limiter is thus braked and the catch mechanism connected with the drive cable and arranged at the lift cabin is released or triggered, wherein depending upon the construction of the catch mechanism the lift cabin is brought to standstill with a more or less pronounced deceleration.

Although the state-of-the-art pendulum limiters, on the one hand, constitute relatively inexpensive robust constructions which embody only very few moved components, on the other hand they are, however, associated with a number of decisive drawbacks. In particular, for constructional reasons it is not possible to exceed a certain spacing of the cams or teeth of the cam disk or the blocking wheel, respectively. Hence, there can exist between the response time of the speed limiter and the release time of the catch mechanism a difference during which the speed of the lift cabin is accelerated to impermissible values. Furthermore, when reaching a critical speed there can arise an unstable condition wherein the accelerating force acting upon the pendulum lever is equal to the opposing spring force, with the result that there can arise damage to the pawl and the teeth. Consequently, there can arise an overshooting of the cam and teeth, producing a further increase of the difference between the response time of the pendulum limiter and the release time of the catch mechanism. Additionally, due to lifting-off of the roller rotatably mounted at the pendulum lever from the cam disk there is no longer insured for a faultless functioning of the pendulum limiter at greater speeds or accelerations. Further drawbacks with this type of speed limiter can be enumerated in terms of the occurrence of fluttering or chattering noises and the need to install a slipping or release clutch, since the elongation of the cable which occurs due to the sudden standstill of the pendulum limiter must be maintained within permissible limits.

In order to prevent triggering or release of the catch mechanism in the presence of small speed excesses, a speed limiter can be equipped with an electric pre-cut-off. This electric pre-cutoff causes the lift control to be interrupted and brings the mechanical brake of the lift cabin to standstill.

According to a known apparatus at a pendulum limiter a mass body movably guided in vertical direction and exposed to the action of an adjustable compression spring is pressed against a stop and is operatively connected with a pendulum lever. When reaching a predetermined travel speed the acceleration forces raise the mass body off the stop against the force of the compression spring, and an actuation bolt fixedly connected with the mass body interrupts an electrical contact.

The drawbacks associated with the oscillating pendulum lever of a pendulum speed limiter also act unfavorably upon the pre-cutoff. An exact defined cut-off is rendered more difficult owing to the complicated dynamic behavior in conjunction with the dimensioning of the components of the pre-cutoff.

Generally, the centrifugal limiters or centrifugal speed limiters do not exhibit the drawbacks associated with the pendulum limiters or pendulum speed limiters noted above. They can be used throughout a large speed range and operate particularly in a faultless manner at high speeds. According to a state-of-the-art centrifugal limiter equipped with an electrical pre-cutoff two weights are pivotably mounted at the cable wheel or rope pulley. Secured to the weights are resilient elements which oppose the movements of the weights brought about by the centrifugal force during rotation of the cable wheel. At one of the weights there is articulated a rod which through the agency of an angle lever axially displaces a piston mounted in a central bore of the cable wheel hub. An initial small displacement of predetermined magnitude is transmitted through the agency of a further angle lever and a further rod directly to an electrical switch which initiates the pre-cut-off and the regulation of the speed. During a greater axial displacement of the piston a pawl is released, resulting in actuation of the movable jaw of a cable brake and the initiation of the braking operation.

The drawbacks of such centrifugal limiters especially reside in their complicated construction, requiring a relatively large number of components. Consequently, it is practically impossible to realize an economical solution. A further disadvantage resides in the fact that the centrifugal limiter is not capable of functioning in a faultless manner at lower speeds.

SUMMARY OF THE INVENTION

Hence, with the foregoing in mind it is a primary object of the present invention to provide a new and improved construction of speed limiting device for lifts or the like which is not associated with the aforementioned drawbacks and limitations of the prior art constructions.

Another and more specific object of the present invention aims at the provision of a new and improved construction of speed limiter for lifts or the like which is both simple in design and economical to manufacture, and which employs the principle of the speed measuring of the prior art pendulum limiter, however does not exhibit the drawbacks thereof, particularly those which result from the coaction between the pawl provided at the pendulum lever and the blocking wheel fixedly connected with the cam disk.

Yet a further object of the present invention aims at the provision of a new and improved construction of speed limiting device for lifts or the like which is relatively uncomplicated in construction, economical to manufacture, relatively simple in design, extremely reliable in operation, and requires a minimum of servicing and maintenance.

Now in order to implement these and still further objects of the invention, which will become more readily apparent as the description proceeds, the speed limiting device or speed limiter for lifts or the like as contemplated by the invention comprises a separate cable brake acting upon the limiter cable and an actuation mechanism which is actuated with a tilting action or behavior upon release of the separate cable brake. The actuation mechanism possesses at least one mass body which is accelerated proportional to the lift travel speed by means of the support or carrier during rotation of the cam disk, and this mass body upon exceeding a predetermined travel speed is moved relative to the support under the action of the inertia forces for releasing or triggering the actuation mechanism.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 4 is a front view of a second embodiment of speed limiter employing a slide serving as the support and illustrating the actuation mechanism in the rest position;

FIG. 5 is a cross-sectional view of the arrangement shown in FIG. 4, taken substantially along the line C—C thereof;

FIG. 6 is a cross-sectional view of the arrangement shown in FIG. 4, taken substantially along the line D—D thereof; and FIG. 7 schematically illustrates the lift cabin arranged at the cable wheel.

DETAILED DESCRIPTION OF THE INVENTION

Figure 1:
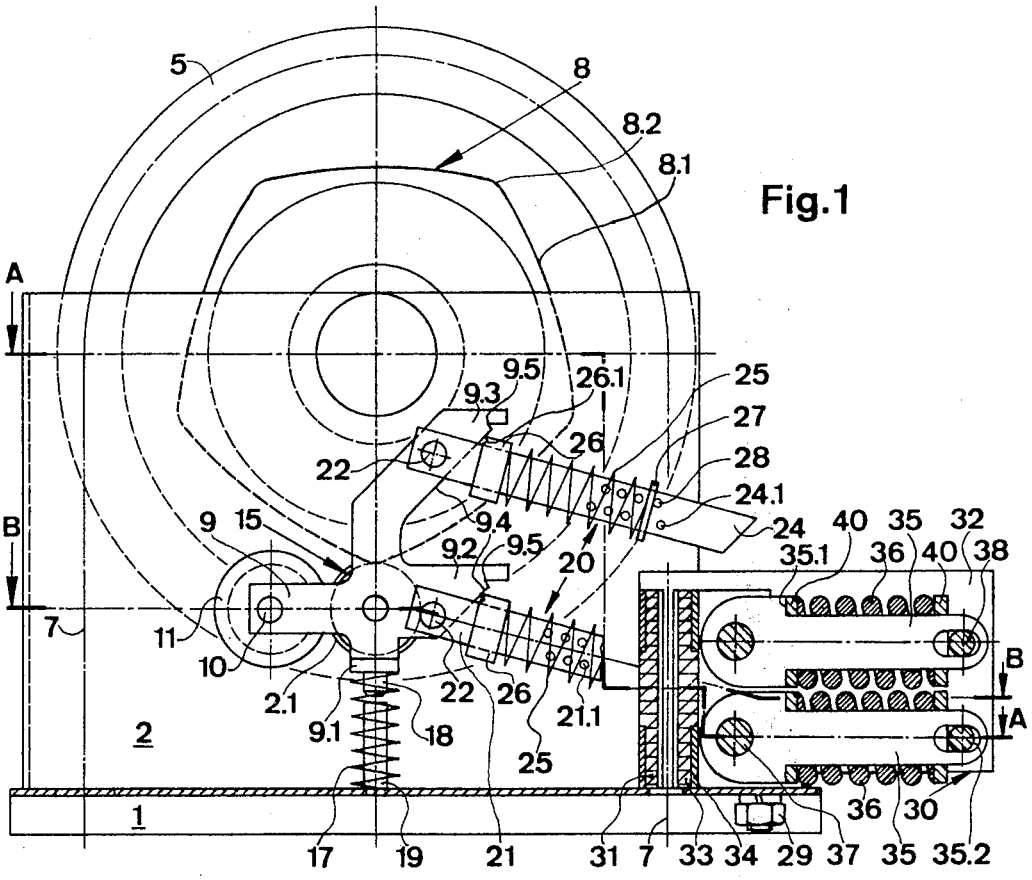
FIG. 1 is a front view, partially shown in section, of a speed limiter or speed limiting device incorporating a single-arm lever as the support and an actuation mechanism in its working position.
Figure 2:
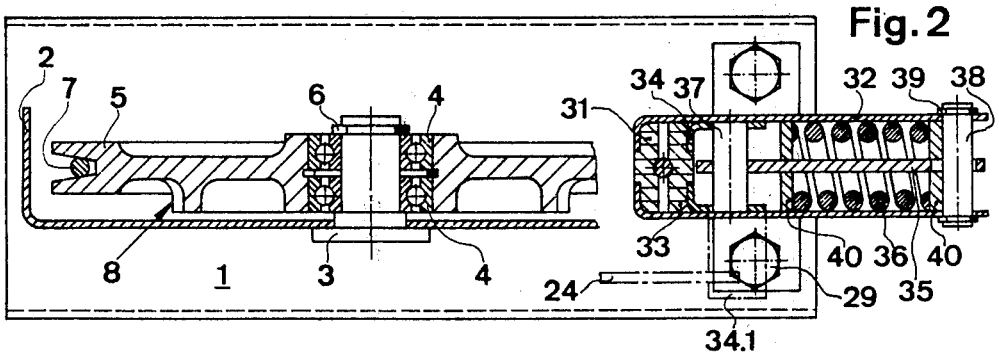
FIG. 2 is a cross-sectional view of the arrangement shown in FIG. 1, taken substantially alont the line A—A thereof.
Figure 3:
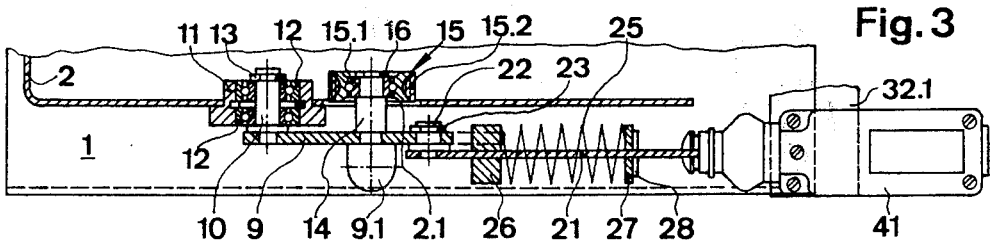
FIG. 3 is a cross-sectional view of the arrangement shown in FIG. 1, taken substantially along the line B—B thereof.

Describing now the drawings, in FIGS. 1 to 3 and 6 a base plate 1 and a bearing plate 2 are rigidly interconnected at substantially right angles with respect to one another. At a pivot journal or pin 3 secured to the bearing plate 2 there is rotatably mounted through the agency of two ball bearings 4 a cable wheel or pulley 5 and secured against axial displacement by means of a ring member or ring 6 or equivalent structure. The cable wheel 5 is driven through the agency of a limiter cable or rope 7 fixedly connected with the lift cabin 100. A cam disk 8 mounted at the cable wheel or pulley 5, preferably cast thereat, and rotating about the same point or axis, possesses at its periphery five cam portions or cam curves 8.1 and five dogs or raised portions 8.2 defined by the points of intersection of the cam portions 8.1. A single-arm lever 9 defining a support and which is branched at its end is rotatably mounted at the bearing or support plate 2 by means of a shaft 10 secured to the lever 9 and two ball bearings 12 or equivalent structure guided in a sleeve or bushing 11. The lever 9 is equally secured against axial displacement by means of a ring member or ring 13 or the like mounted upon the shaft 10. A roller or roll 15 is rotatably mounted at the single-arm lever 9 by means of a shaft 14 which is fixedly connected with such lever 9, roller 15 being secured by a ring 16. The roller 15 consists of a ball bearing 15.1 at the outer race of which there is applied a covering or coating 15.2 formed of any suitable wear-resistant, sound-dampening non-metallic material. The roller or roll 15 protrudes through an opening or passage 2.1 located in the bearing or support plate 2 and is pressed by means of a spring 17 against the periphery of the cam disk or plate 8. The spring 17 is guided at one end by means of a bolt 18 secured at a flexed or bent portion 9.1 of the single-arm lever 9 and is guided at its other end by means of a bolt 19 mounted at the base plate 1.

The single-arm branched lever or lever member 9 possesses a lower branched portion or branch 9.2 and an upper branched portion or branch 9.3, at each of which there is present a respective beveled or inclined portion 9.4 and a preferably acute angle notch or recess 9.5. An actuation mechanism or means 20 exhibiting a tilting or pivotal behavior or action is provided at the branched portions 9.2 and 9.3. This actuation mechanism or means 20 consists of a switching or switch arm 21 serving as the mass body and articulated at the lower branched portion 9.2 by means of a bolt 22 or the like secured by a ring or ring member 23 and an actuation arm or arm member 24 also serving as a mass body and articulated at the upper branched portion 9.3 by means of a bolt 22 which is equally secured in position by a ring or ring member 23. Both at the switching arm 21 and also at the actuation arm 24 there is provided a stop or impact disk or plate 26 serving as an additional mass body and displaceable under the pressure of an adjustment or setting spring 25. Each impact or stop disk 26 possesses a preferably acute angle nose member 26.1 which is in engagement with its notch 9.5. The adjustment spring 25 can be adjusted to the required pre-bias by means of a displaceable disk or plate 27 and a pin 28 which can be inserted into holes or bores 21.1 and 24.1 provided at the switching arm 21 and the actuation arm 24, respectively.

Secured to the base plate 1 by means of screws 29 or equivalent structure is a cable or rope brake 30. A non-movable brake jaw 31 of the cable brake 30 is fixedly connected with a cable brake housing 32. A movable brake jaw 33 is attached to a bracket or bracket member 34 guided in the cable brake housing 32. Two levers 35 which are subjected to the action of a respective compression or pressure spring 36 are hingedly connected or articulated at one end at two bolts 37 mounted in the bracket 34 and at the other end are rotatably mounted at two shafts 38 mounted in the cable brake housing 32 and secured by means of the rings 39. Each compression spring 36 is pre-biased or pre-stressed between two disks or plates 40, the one disk 40 bearing at a shoulder 35.1 of the lever 35 and the other disk or plate 40 bearing at the shaft 38. Elongate holes or slots 35.2 provided in the levers 35 render possible a displacement thereof and thus also the movable brake jaw 33 in the effective or working direction of the compression or pressure spring 36. At the bracket 34 there is provided an actuation member 34.1, for instance formed of sheet metal, by means of which the actuation arm 24 displaces the movable brake jaw 33. At a support or carrier 32.1 connected with the cable brake housing 32 there is attached an electrical switch 41 which is actuated by means of switch arm 21 and by means of a tongue or tab 34.11 provided at the sheet metal actuation member or element 34.1.

Continuing, in the modified exemplary embodiment of speed limiting device for lifts or the like as depicted in FIGS. 4 to 6, it is to be understood that reference characters 1, 3 to 8, 15 and 20 to 41 designate the same or analogous components discussed above with respect to the embodiment disclosed in conjunction with FIGS. 1 to 3 and 6. Two tongues or tabs 42.1 and 42.2. are bent or flexed out of a sheet metal bearing or support plate 42 which is fixedly connected with the base plate 1. In these tongues or tabs 42.1 and 42.2 there is displaceably mounted a shaft 43. The upper end of the shaft 43 which is equipped with threading and a nut member 44 bears through the agency of two plate springs 45 and a spring 46 upon the tongue or tab 42.1. The lower end of the shaft 43 which is likewise provided with threading is secured by means of a further nut member 44 at a bracket 47 which is fixedly connected with a slide or slide member 48 defining a support and possessing in plan view an essentially rectangular configuration. The slide member 48 possesses at its narrow sides a respective bent or flexed leg 48.1, 48.2 and is retained in vertical position by means of the shaft 43 which is guided in a not particularly referenced bore of the upper leg or leg member 48.1. At one lengthwise extending side of the slide member 48 there is provided a lower projection or protuberance 48.3 and an upper projection or protuberance 48.4, each of which possess a beveled or inclined portion 48.5 and a preferably acute angle notch or recess 48.6. Hingedly connected with the slide 48 is the actuation mechanism or device means 20, and the nose members 26.1 of the impact of stop disks 26 engage in the notches or recesses 48.6 of the projections 48.3, 48.4. The roller or roll member 15 is rotatably mounted at a bolt 49 or equivalent structure secured at the bracket 47. This roll or roller member 15 extends through an opening or passage 42.3 located in the sheet metal bearing member or plate 42 and is biased by means of the spring 46 against the periphery of the cam disk or plate 8. The slide 48 is guided by means of two leaf springs 50 or the like without friction at the sheet metal bearing member 42. The one respective end of each of the leaf or blade springs 50 is secured at the neighboring leg 48.1 and 48.2, respectively, of the slide 48 by means of an associated clamping plate 53 held by a screw 51 and a nut or nut member 52, as best seen by referring to FIG. 4. The other end of each such spring 50 is likewise secured by two further clamping plates 53 at the angled portions or angled legs 54, these clamping plates 53 being held by screws 51 and nut members 52. The angle members 54 are displaceably connected with the sheet metal bearing member or plate 42.

The described speed limiter or speed limiting device operates as follows:

The cable wheel or pulley 5 and the cam disk or plate 8 which is fixedly connected therewith are driven via the limiter cable or rope 7 with a rotational speed which is proportional to the speed of the lift cabin. As a result, the single-arm lever 9 or the slide 48 together with the hingedly connected actuation mechanism 20 are placed into oscillatory movement via the roller 15 pressed against the periphery of the cam disk 8. The spring 17 or 46 acting upon the single-arm lever 9 or the slide or slide member 48, respectively, is dimensioned and pre-stressed in such a manner that the roller 15 in the working range of the speed limiter does not lift-off the periphery of the cam disk 8. The switching arm 21 and also the actuation arm 24 of the actuation mechanism 20, during the rest position and up to a predetermined release speed, are located in a ratcheted horizontal position (FIG. 4), wherein the nose members 26.1 of the impact or stop disks 26 are engaged with the notches or recesses 9.5 or 48.6 of the lever 9 or the slide 48 respectively. The pre-stress or prebias of the adjustment spring 25 of the switching arm 21, and which is adjusted by means of the disk 27 and pin 28, is smaller than the pre-bias of the adjustment spring 25 of the actuation arm 24, so that upon reaching a first release or trigger speed the switching arm 21 is downwardly tilted into an inclined position corresponding to its work position (FIG. 1). Consequently, the electrical switch 41 is actuated, and the lift control is interrupted or cut-off and the mechanical brake brings to standstill the lift cabin. However, if owing to a defect, such as for instance rupture of the support cable, the speed of the lift cabin further increases, then during a second larger release or trigger speed the actuation arm 24 shifts or tilts downwardly into an inclined position corresponding to its work position (FIG. 1). As a result, it presses against the sheet metal actuation member 34.1, and the movable brake jaw 33 is tilted out of its rest position (FIG. 4) fixed by means of a not further illustrated stop holder into a work position (FIG. 1), and the limiter cable or rope 7 is braked, the catch mechanism is released and the lift cabin comes to standstill. Upon pivoting or tilting down into the work position the adjustment springs 25 relax, so that the nose members or noses 26.1 of the stop or impact disks 26 of the switching arm 21 as well as also the actuation arm 24 come into contact with the inclined or beveled portions 9.4 or 48.5 of the lever 9 or the slide 48, respectively, whereby there is prevented a tilting back into the horizontal rest position.

If the actuation arm 24 tilts back out of the rest position into the work position at a point in time prior to the switching arm 21, then the switching arm 21 is pressed or urged by means of the tongue 34.11 into the work position, whereby, at the same time, the cable brake 30 is activated and the lift control is cut-off or interrupted.

It is within the framework of the invention to employ also other generally known stop holders for the latching-in of the actuation mechanism 20. Thus, for instance, ball locking or latching holders or magnetic locking or latching holders can be employed. In order to realize the tiltable action or behavior of the actuation mechanism 20 there can be employed other devices, known from the switch technology, which bring about the jump actuation or momentary switching, equipped for instance with tension springs or leaf springs. The follow-up or guiding of the support 9, 48 at the cam disk 8 instead of being realized by a force-locking action by means of the springs 7, 46, for instance also could be realized by a form-locking action, for instance by means of a cam disk with two parallelly extending cam portions between which there is guided the roller 15.

While there is shown and described present preferred embodiments of the invention, it is to be distinctly understood that the invention is not limited thereto, but may be otherwise variously embodied and practiced within the scope of the following claims.

What is claimed is:

1. A speed limiting device for lifts or the like including a lift cabin, comprising a limiter cable attachable to the lift cabin, a cable wheel drivable by means of the limiter cable, a shaft, a cam disk fixedly connected with the cable wheel and seated together with said cable wheel upon said shaft, a support which is moved by said cam disk, a separate cable brake acting upon the limiter cable, actuation means which upon activating the separate cable brake is actuated with a tilting action, said actuation means possessing at least one mass body which is accelerated substantially proportionally to the lift travel speed by the support when the cam disk rotates, said mass body upon exceeding a predetermined travel speed being movable relative to the support under the action of the inertia forces for releasing the actuation means, a bearing plate, said support comprising a single-arm lever rotatably mounted in said bearing plate, said lever being branched at one end thereof to form an upper branched portion and a lower branched portion, each branched portion being provided with an inclined portion and a notch, a roller rotatably mounted at said lever, and spring means for pressing said roller against the periphery of the cam disk.

2. The speed limiting device for lifts as defined in claim 1, further including means for latching under spring pressure at least said one mass body with the support.

3. The speed limiting device for lifts as defined in claim 1, further including an electrical switch, said actuation means incorporating a switching arm and an actuation arm constituting said mass body, said switching arm operatively coacting with said electrical switch, means for pivotably connecting said switching arm with said lower branched portion of said single-arm lever, means for pivotably connecting said actuation arm with the upper branched portion of said single-arm lever, said cable brake including a movable brake jaw, said actuation arm operatively coacting with said movable brake jaw, a displaceable stop disk provided for each said switching arm and said actuation arm, a respective adjustment spring for exerting a force upon each of said stop disks, each of said stop disks possessing a nose member, said switching arms and said actuation arm each being movable between a rest position and a working position, the nose members of said stop disks being in engagement with said notches of said branched portions of said switching arm and said actuation arm when said switching arm and said actuation arm are in their respective rest position until reaching a release speed of the speed limiting device, the pre-bias of the adjustment spring of the switching arm being smaller than the pre-bias of the adjustment spring of the actuation arm, so that upon reaching a first release speed the switching arm is downwardly pivotable out of a substantially horizontal position corresponding to its rest position into an inclined position corresponding to its working position, said nose member of said stop disk of said switching arm then being in engagement with said inclined portion of the lower branched portion of said single-arm lever, and upon reaching a second larger release speed said actuation arm is downwardly pivotable out of a substantially horizontal position corresponding to its rest position into an inclined position corresponding to its working position, said nose member of said stop disk of said actuation arm then being in engagement with said inclined portion of said upper branched portion of said single-arm lever.

4. A speed limiting device for lifts or the like including a lift cabin, comprising a limiter cable attachable to the lift cabin, a cable wheel drivable by means of the limiter cable, a shaft, a cam disk fixedly connected with the cable wheel and seated together with said cable wheel upon said shaft, a support which is moved by said cam disk, a separate cable brake acting upon the limiter cable, actuation means which upon activating the separate cable brake is actuated with a tilting action, said actuation means possessing at least one mass body which is accelerated substantially proportionally to the lift travel speed by the support when the cam disk rotates, said mass body upon exceeding a predetermined travel speed being movable relative to the support under the action of the inertia forces for releasing the actuation means, a shaft member, said support comprising a slide linearly guided by means of said shaft member, said slide including a side portion extending in the direction of movement of said slide, said slide side portion possessing a lower projection and an upper projection, an inclined portion and a notch provided at each said projection, a roller rotatably mounted at said slide, and spring means for pressing the roller against the circumference of the cam disk.

5. The speed limiting device for lifts as defined in claim 4, further including means for latching under spring pressure at least said one mass body with the support.

6. The speed limiting device for lifts as defined in claim 4, further including an electrical switch, said actuation means incorporating a switching arm and an actuation arm defining said mass body, said switching arm operatively coacting with said electrical switch, means for pivotably connecting said switching arm with said slide, means for pivotably connecting said actuation arm with said slide, said cable brake including a movable brake jaw, said actuation arm operatively coacting with said movable brake jaw, a displaceable stop disk provided for each said switching arm and said actuation arm, a respective adjustment spring for exerting a force upon each of said stop disks, each of said stop disks possessing a nose member, said switching arm and said actuation arm each being movable between a rest position and a working position, the nose members of said stop disks being in engagement with said notches of said projections of said switching arm and said actuation arm when said switching arm and said actuation arm are in their respective rest position until reaching a release speed of the speed limiting device, the pre-bias of the adjustment spring of the switching arm being smaller than the pre-bias of the adjustment spring of the actuation arm, so that upon reaching a first release speed the switching arm is downwardly pivotable out of a substantially horizontal position corresponding to its rest position into an inclined position corresponding to its working position, said nose member of said stop disk of said switching arm then being in engagement with said inclined portion of the lower projection of said slide, and upon reaching a second larger release speed said actuation arm is downwardly pivotable out of a substantially horizontal position corresponding to its rest position into an inclined position corresponding to its working position, said nose member of said stop disk of said actuation arm then being in engagement with said inclined portion of said upper projection of said slide.

* * * * *